US007582593B2

(12) United States Patent
Kaufman

(10) Patent No.: US 7,582,593 B2
(45) Date of Patent: Sep. 1, 2009

(54) COMPOSITIONS AND METHODS FOR USE IN UNCLOGGING DRAINS AND PIPES

(75) Inventor: Karin Kaufman, 35 Laurel Rd., Pound Ridge, NY (US) 10576

(73) Assignee: Karin Kaufman, Pound Ridge, NY (US)

( * ) Notice: Subject to any disclaimer, the term of this patent is extended or adjusted under 35 U.S.C. 154(b) by 511 days.

(21) Appl. No.: 11/391,759

(22) Filed: Mar. 29, 2006

(65) Prior Publication Data

US 2006/0223733 A1 Oct. 5, 2006

Related U.S. Application Data

(60) Provisional application No. 60/667,361, filed on Apr. 1, 2005.

(51) Int. Cl.
*C11D 17/00* (2006.01)

(52) U.S. Cl. ..... 510/195; 510/462; 510/470

(58) Field of Classification Search ..... None
See application file for complete search history.

(56) References Cited

U.S. PATENT DOCUMENTS

| | | | |
|---|---|---|---|
| 1,715,337 | A | 5/1929 | Coughlin |
| 3,635,797 | A | 1/1972 | Battistoni et al. |
| 4,610,800 | A | 9/1986 | Durham et al. |
| 6,479,444 | B1 | 11/2002 | Porticos et al. |
| 2003/0045439 | A1 | 3/2003 | Evers |

OTHER PUBLICATIONS

Written Opinion and International Search Report from International Application No. PCT/US06/11366 completed on Jun. 1, 2007.

*Primary Examiner*—Necholus Odgen, Jr.
(74) *Attorney, Agent, or Firm*—Clark & Elbing LLP

(57) ABSTRACT

The invention provides compositions and methods for use in unclogging drains and pipes.

16 Claims, No Drawings

COMPOSITIONS AND METHODS FOR USE IN UNCLOGGING DRAINS AND PIPES

CROSS-REFERENCE TO RELATED APPLICATIONS

This application claims benefit of the filing date of U.S. Provisional Application No. 60/667,361, filed on Apr. 1, 2005.

FIELD OF THE INVENTION

The invention relates to compositions and methods for unclogging drains and pipes.

BACKGROUND OF THE INVENTION

Plumbing systems including drains and pipes are integral components of all modern buildings. Such systems mainly function to convey liquids and water-soluble material. However, even material that is appropriate for entry into such systems (e.g., soap residue) sometimes accumulates within the system, leading to the formation of a clog. Further, it is not uncommon for material that should not enter such systems to gain entry nonetheless and contribute to clog formation. Removal of clogs from plumbing systems is essential to the proper functioning of the systems and associated fixtures. A professional can be hired to remove a clog, but this can be expensive. Chemical solutions are commercially available for use in clog removal but, by repeated or inappropriate use, these solutions can be harmful to drains and pipes. Further, such solutions can be harmful to humans, if contacted with the skin or eyes, or ingested. A need exists for safe, cost-efficient approaches to unclogging drains.

SUMMARY OF THE INVENTION

The invention provides compositions for use in unclogging drains and pipes. The compositions of the invention include molasses (obtained, e.g., from sugar cane; e.g., unprocessed sugar cane juice), fish oil (e.g., cod liver oil), and crushed coffee cruda. In one example of a composition of the invention, the molasses and fish oil are present in the composition at a ratio of approximately 3:1. For example, the composition can include two tablespoons of molasses and two teaspoons of fish oil, or an equivalent multiple of each of these amounts. The compositions of the invention also can include two pellets of crushed or dissolved coffee cruda for each two tablespoons of molasses and each two teaspoons of fish oil.

The invention also provides methods of unclogging drains or pipes, involving contacting a clog in a drain or a pipe with a composition as described above, in one or more applications. In these methods, the composition can be poured into an orifice that leads to interior region of the drain or the pipe that includes the clog. The methods of the invention can also include, optionally, because the solution is also an expectorant, use of a mechanical means for unclogging the drain or the pipe (e.g., a plunger, a snake, or an auger).

Further, the invention provides vessels (e.g., bottles, cans, or envelopes) that include the compositions described above. Such vessels can include a label indicating use of the composition in the vessels for unclogging drains or pipes, and can be made of, e.g., glass, plastic, or a metal such as aluminum. The vessels may also include directions that instruct the user to pour the formula into the drain and let it stand for a period of time (e.g., 5-30 or 10-15 minutes) prior to flushing with water. Optionally, the vessels may further include, as an integral component or attachment, a device that can be used as a mechanical means for unclogging the drain or pipe.

The invention provides several advantages. For example, in contrast to many prior, commercially available products for use in unclogging drains, which can be skin and eye irritants, emit fumes, and otherwise be hazardous, the compositions of the present invention are safe and non-caustic. In addition, because of the safety of the compositions of the invention, they can be used in combination with mechanical approaches to drain unclogging (e.g., a plunger, a snake, or an auger), without the risk of these approaches causing the splattering and thus potential human contact with dangerous chemicals. Moreover, in contrast to many prior products, the compositions of the present invention do not cause damage to drains and pipes.

Other features and advantages of the invention will be apparent from the following detailed description and the claims.

DETAILED DESCRIPTION

The invention provides compositions and methods for use in unclogging drains and pipes. Preferably, use of the invention leads to complete removal of a clog and pipe maintenance, but partial removal of a clog by use of the invention is possible as well.

The compositions of the invention include molasses, fish oil (preferably, cod liver oil), and crushed coffee cruda. In a preferred example, the compositions include these ingredients in the following relative amounts: 2 tablespoons of molasses, 2 teaspoons of fish oil, and 3 pellets of crushed coffee cruda. Thus, the ratio of molasses to fish oil in the preferred compositions of the invention is 3:1. In other variations, the ratio of these ingredients can be, e.g., 10:1, 8:1, 6:1, 4:1, 2:1, 1:1, 1:2, 1:4, 1:6, 1:8, or 1:10. Further, in other variations, the amount of crushed coffee cruda included in the compositions can range from ½-10 pellets for the amounts of molasses and fish oil noted above, e.g., 1, 2, 3, 4, 5, 6, 7, 8, 9, or 10 pellets can be used.

As is known in the art, molasses is juice that is obtained from sugar plants, such as sugar cane and sugar beets. It generally includes uncrystallizable sugars, as well as sucrose, which can vary in concentration depending upon, for example, whether the molasses has been treated in a manner so as to remove the sucrose. In the present invention, it is preferred that the molasses be obtained from sugar cane, although other sources of molasses can also be used. Further, different grades of molasses can be used in the invention. In particular, as is known in the art, the purest molasses is pure cane juice, as is present in Grandma's Original Molasses (Gold Label)(Motts, Inc.), from which sugar has not been extracted. It is preferred to use molasses of this high purity, which can, optionally, be clarified and concentrated. Alternatively, molasses that remains after sugar has been crystallized and thus removed from the molasses (e.g., Grandma's Robust Molasses (Green Label)) can be used. Further, molasses resulting from 1-3 or more such cycles of sugar removal can be used. As is known in the art, molasses prepared from green sugar cane that is not fully mature is often treated with sulfur fumes during the sugar extraction process. Preferably, the molasses used in the present invention has not been sulfur treated, but sulphured molasses can also be used.

Cod liver oil used in the invention can be obtained from any of a number of commercial sources including, for example, Twinlab (Hauppauge, N.Y.), Carlson Laboratories (Arlington Heights, Ill.), and Swanson Health Products (Fargo, N. Dak.). As alternatives to cod liver oil, other fish oils can be used in the invention. For example, oil obtained from mackerel, salmon, herring, sardines, sablefish, anchovies, and albacore tuna can be used. As a less preferred alternative, oils from vegetable sources, such as flaxseed oil, can be used.

Coffee cruda (unroasted coffee; homeopathic coffee) for use in the invention can be obtained from any of a number of commercial sources. For example, Coffee Cruda 30c from Boiron Homeopathics can be used. Other commercial sources include Life's Vigor Natural Health & Beauty Store (Bakersfield, Calif.), Boericke & Tafel Homeopathics (Nature's Way; Springville, Utah), and Homeocan Inc. (Montreal, Canada). Coffee cruda pellets used in the invention are typically of a weight of approximately 50 mg, but this weight may vary, for example, by ±5-20%.

The compositions of the invention can be prepared simply by admixing the molasses, fish oil, and crushed coffee cruda in the ratios noted above. The amount can be scaled-up, as appropriate. Further, for convenience in commercializing the product, it can be packaged in different sizes. Optionally, the composition can be concentrated using standard methods, and sold with instructions to dilute the concentrate, as appropriate.

The compositions and methods of the invention can be used in household applications, for example, in unclogging drains and pipes associated with sinks, tubs, showers, spas, garbage disposals, washing machines, toilets, and bidets. The invention can also be used in commercial settings for unclogging drains and pipes associated with these and other fixtures. Further, the invention can also be used in the context of exterior drainage systems and associated fixtures. Examples of clogs that can be removed, according to the invention, are those that include any one or more of hair, fur, soap and soap scum, body oils, sludge, grease, food, paper, leaves and other organic waste, and other household, commercial, and outdoor debris that can clog drains and pipes.

The compositions of the invention can be applied to clogs in drains and pipes simply by pouring them into the drains and pipes themselves (or one or more other conduits leading to the pertinent drain or pipe), and letting gravity facilitate contact of the composition with the clog. Optionally, water or other liquid standing between the opening to the drain or pipe (or conduit thereto) is removed (e.g., by siphoning) prior to contact of a composition of the invention with a clog. This is not generally necessary, as the compositions of the invention can be denser than, and therefore penetrate through, liquids such as water. In another alternative, a device that can be fed through a drain or pipe system can be used to deliver the composition to the clog.

A composition or method of the invention can be used as the sole approach to unclogging a pipe or drain, or can be used in combination with other approaches. For example, the compositions and methods can be used in combination with one or more of plungers, snakes or augers, and unclogging devices that expel water or compressed air under pressure.

What is claimed is:

1. A composition comprising molasses, fish oil, and crushed or dissolved coffee cruda.

2. The composition of claim 1, wherein the molasses is obtained from sugar cane juice.

3. The composition of claim 2, wherein the sugar cane juice is unprocessed.

4. The composition of claim 1, wherein the fish oil is cod liver oil.

5. The composition of claim 1, wherein the molasses and fish oil are present in the composition at a ratio of approximately 3:1.

6. The composition of claim 5, wherein the composition comprises two tablespoons of molasses for every two teaspoons of fish oil, or an equivalent multiple of each of these amounts.

7. The composition of claim 1, wherein the composition comprises two crushed or dissolved pellets of coffee cruda for each two tablespoons of molasses and each two teaspoons of fish oil.

8. A method of unclogging a drain or a pipe, the method comprising contacting a clog in the drain or the pipe with the composition of claim 1.

9. The method of claim 8, wherein the composition is poured into an orifice that leads to the interior region of the drain or the pipe that comprises the clog.

10. The method of claim 8, further comprising use of a mechanical means for unclogging the drain or the pipe.

11. The method of claim 10, wherein the mechanical means is selected from the group consisting of a plunger, a snake, or an auger.

12. The method of claim 8, wherein the method comprises more than one application of the composition.

13. A vessel comprising the composition of claim 1.

14. The vessel of claim 13, wherein the vessel is a bottle, can, or envelope.

15. The vessel of claim 13, wherein the vessel comprises a label indicating use of the composition in the vessel for unclogging drains or pipes.

16. The vessel of claim 15, wherein the label instructs the user to pour the composition into the drain or pipe and to let it stand prior to flushing with water.

* * * * *

UNITED STATES PATENT AND TRADEMARK OFFICE

CERTIFICATE OF CORRECTION

PATENT NO. : 7,582,593 B2
APPLICATION NO. : 11/391759
DATED : September 1, 2009
INVENTOR(S) : Kaufman It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 511 days.

Delete the phrase "by 511 days" and insert -- by 667 days --

Signed and Sealed this

Twenty-seventh Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,582,593 B2
APPLICATION NO. : 11/391759
DATED : September 1, 2009
INVENTOR(S) : Karin Kaufman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 823 days.

Signed and Sealed this

Fourteenth Day of September, 2010

David J. Kappos

David J. Kappos
*Director of the United States Patent and Trademark Office*